US005864202A

United States Patent [19]

Cserteg et al.

[11] Patent Number: 5,864,202

[45] **Date of Patent: *Jan. 26, 1999**

[54] LIGHT SOURCE INCLUDING A FIXING COMPONENT FOR JOINING A LAMP ENVELOPE TO AN ELECTRIC LIGHT SOURCE

[75] Inventors: Erzsebet Cserteg, Budapest; Sandor Lukacs, Veroce; Jozsef Tokes, Budapest; Istvan Wursching, Budapest; Jozsef Fulop, Budapest, all of Hungary

[73] Assignee: General Electric Company, Schenectady, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 696,219

[22] Filed: Aug. 13, 1996

[51] Int. Cl.[6] ..... F21S 1/00

[52] U.S. Cl. ..... 313/318.08; 313/318.09; 313/318.1

[58] Field of Search ..... 313/318.08, 318.09, 313/318.12, 318.1; 439/611, 615, 226, 276

[56] References Cited

U.S. PATENT DOCUMENTS

| | | | |
|---|---|---|---|
| 2,451,900 | 10/1948 | Zambakian | 313/318.08 X |
| 3,047,765 | 7/1962 | Vichill | 313/318.08 |
| 5,630,662 | 5/1997 | Ooms | 313/318.08 X |

FOREIGN PATENT DOCUMENTS

| | | | |
|---|---|---|---|
| 881106 | 11/1961 | United Kingdom | 313/318.08 |

*Primary Examiner*—Jeff H. Aftergut
*Attorney, Agent, or Firm*—Fay, Sharpe, Beall, Fagan, Minnich & McKee

[57] ABSTRACT

The fixing component has a groove for accepting an adhesive material, which groove is fixed to the housing of the light source and extends along a circle, The essential feature of the invention is that in the wall (8) of the groove (6) being at the side closer to the housing **(1*a*), openings (9) are formed that enable the adhesive material (4) to flow to the surface of the housing (1*a*)**.

9 Claims, 2 Drawing Sheets

Fig. 3
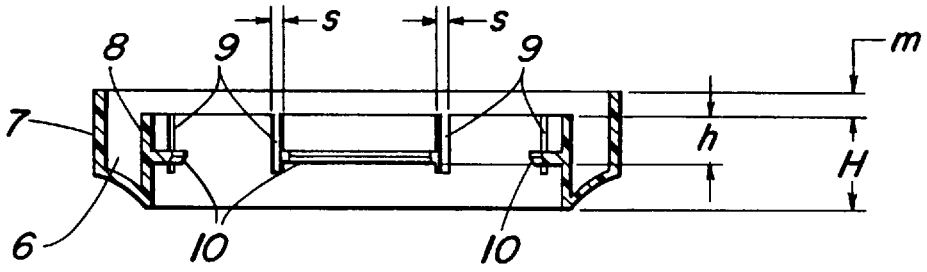
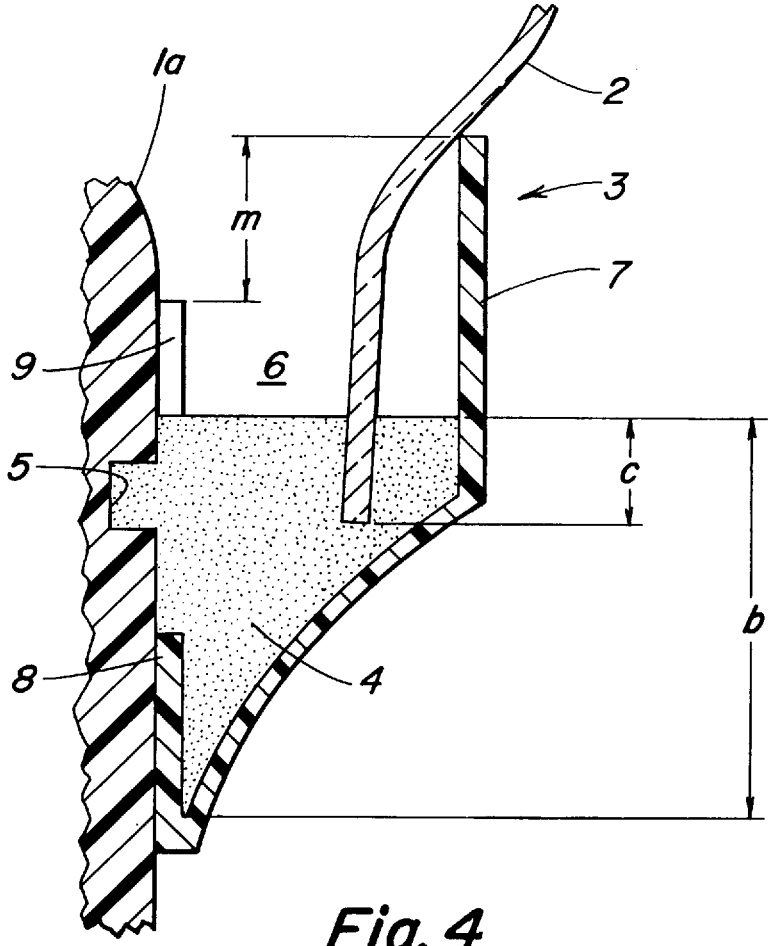
Fig. 4

LIGHT SOURCE INCLUDING A FIXING COMPONENT FOR JOINING A LAMP ENVELOPE TO AN ELECTRIC LIGHT SOURCE

The invention relates to a fixing component for joining a lamp envelope to an electric light source which fixing component has a groove for accepting an adhesive material, which groove can be fixed to the light source and extends along a circle and is bordered by walls at a certain distance from each other. The fixing component according to the invention can be used with advantage e.g. for joining a lamp envelope to a compact fluorescent lamp.

For compact fluorescent lamps, it is a widespread and increasing requirement to have a construction being suitable for replacing conventional incandescent lamps. Since compact fluorescent lamps, by assembling them with a lamp envelope of appropriate size can be made suitable for replacing decorative (Globe) lamps listed in the type choice of incandescent lamps, this combination Is being used worldwide. To fix or join the compact fluorescent lamp and the lamp envelope to each other, an annular shaped fixing component (adapter) is used, and fixing the compact fluorescent lamp and the lamp envelope to each other is performed by inserting this component, thus the presently known solutions use an indirect method for fixing, i.e. the fixing component is joined to the housing of the compact fluorescent lamp, and the lamp envelope is joined to the fixing component.

According to a known solution, the adapter made from plastic is pulled over the housing of the compact fluorescent lamp and is—making use of the resilient deformation property of plastic—snapped on the housing. In the next step, the rim of the plastic envelope is joined to the annular shaped fixing component (adapter) using the same method, i.e. by snapping. It is understood by itself that parts enabling to make the snapped joint, thus tabs, ribs, seals, notches, etc. should be provided both on the housing and on the envelope and on the adapter. This can raise problems not only in view of the manufacturing process and of assembling but it is also questionable if the joint in the finished product will be safe enough in respect of resistance to mechanical load. To explain, the mechanical joint has to be able to withstand a torsion moment of definite value (according to the relevant specification, 3 Nm) in order that a Globe lamp can be connected to and disconnected from its socket. It is rather difficult to create a construction that is suitable for assembling, i.e. enables the fixing component to be snapped onto the housing of the compact fluorescent lamp and still prevents the fixing component from being turned away when exposed to the said torsion moment of 3 Nm.

The adhesive joint—also known to the art—was aimed to eliminate at least partly the disadvantages of this unsafe and complicated mechanical (snapped) fixing method. For this, an annular shaped fixing component was used that is joined with snapping method to the housing of the compact fluorescent lamp only, by means of resiliently deformable tabs; the rim of the envelope is dipped into an adhesive material filled into a groove of the fixing component, and setting of the adhesive material results in an adhesive joint between the envelope and the adapter. In this case, the mechanical joint is first made between the fixing component and the housing of the compact fluorescent lamp and sticking with the adhesive or gluing is performed thereafter using the method mentioned. It is an inherent disadvantage of this solution that it keeps the mechanical joint between fixing component and housing, with all the disadvantages of this type of joint described above in detail. In addition, the groove of the fixing component has to be fully filled up with the rather expensive liquid adhesive material which has a negative economical effect.

The objective of the invention is to provide a fixing component for joining a lamp envelope to an electric light source, in particular to a compact fluorescent lamp which fixing component eliminates the disadvantages described above in connection with the mechanically snapped joint used by known solutions for similar purpose and is more advantageous than these, in respect of economy, of assembling technology as well as of functioning, i.e. fixing safety, The invention is based on the recognition that if—for joining a lamp envelope to an electric light source, e.g. to the housing of a compact fluorescent lamp—a fixing component is used that has a groove suitable for accepting a viscous liquid adhesive material and the inner walls of this groove which walls are closer to the housing, have through openings at definite places, then the liquid adhesive material will flow onto the outside surface of the housing through these openings. Due to this, an adhesive joint being more advantageous in every respect than the mechanical joint will be made not only between the lamp envelope dipped by its rim into the adhesive material filled into the groove and the fixing component but also between the housing and said fixing component, and both joints will take place in the same operation of adhesive sticking. Based on the above recognition, the objective set was, according to the invention, achieved by means of a fixing component having a groove for accepting an adhesive material, which groove is fixed to the housing of a light source, e.g. of a compact fluorescent lamp, extends along a circle and is bordered by walls at a certain distance from each other which fixing component is characterized in that in the inside wall of the groove being at the side closer to the housing, openings are formed that enable the adhesive material to flow to the outside surface of the housing. The openings are preferably formed in the wall to have identical lateral distances from each other. Another feature of the invention is that the openings are made in the form of slots starting from the rim of the wall and the width of which is preferably 1 to 3 mm.

A preferred embodiment of the fixing component is characterized in that it has ribs mechanically fixing the groove to the housing, suitable for resilient deformation, protruding from the wall being closer to the housing and are snapped in a notch indented into the outside surface of the housing. It is preferable in this case if the ribs have equal lengths, and said ribs are spaced at identical lateral distances, and the notch is covered by the openings formed in the inside wall. Lamp envelopes generally have circular symmetry, so it is preferable to form the fixing component as one member from plastic by means of injection molding. In the following, the invention will be described in details based on the drawings attached which show a preferred embodiment of the fixing component and the way of its use in a compact fluorescent lamp.

in the drawings:

In FIG. 1, the joint made between a compact fluorescent lamp and a lamp envelope by means of the fixing component according to the invention is seen, partly in side view and partly in the section taken along the longitudinal central geometrical axis of the compact fluorescent lamp.

FIG. 3 is the section taken along line A—A indicated in FIG. 2.

Figure 1:
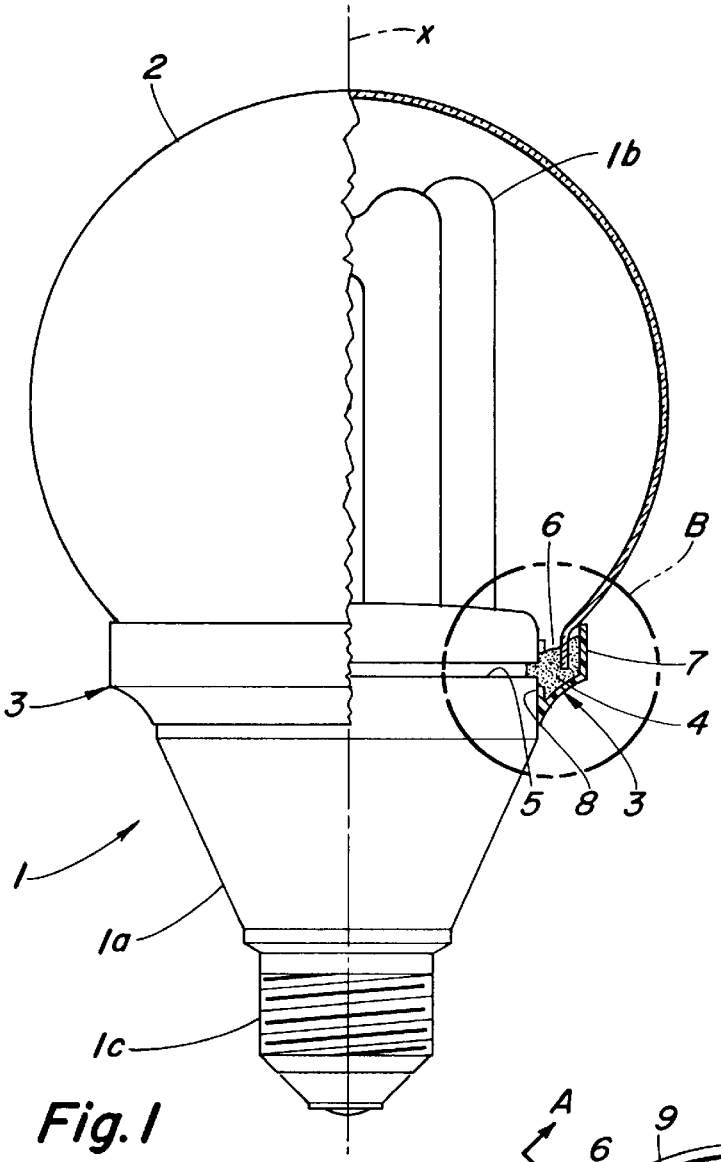

In FIG. 4, detail B encircled in FIG. 1 is shown on a larger scale.

The light source seen in FIG. 1 with longitudinal central geometrical axis x has a compact fluorescent lamp 1 and a lamp envelope 2 which are, according to the invention joined to each other by means of fixing component 3 and adhesive material 4. Base 1*c* enabling connection to a socket (not shown) and discharge tube 1*b* (of hex or oct type) placed inside the envelope 2 belong to housing 1*a* of the compact fluorescent lamp 1. A notch 5 extending around a circle is formed on the outside of housing 1*a*.

Figure 2:
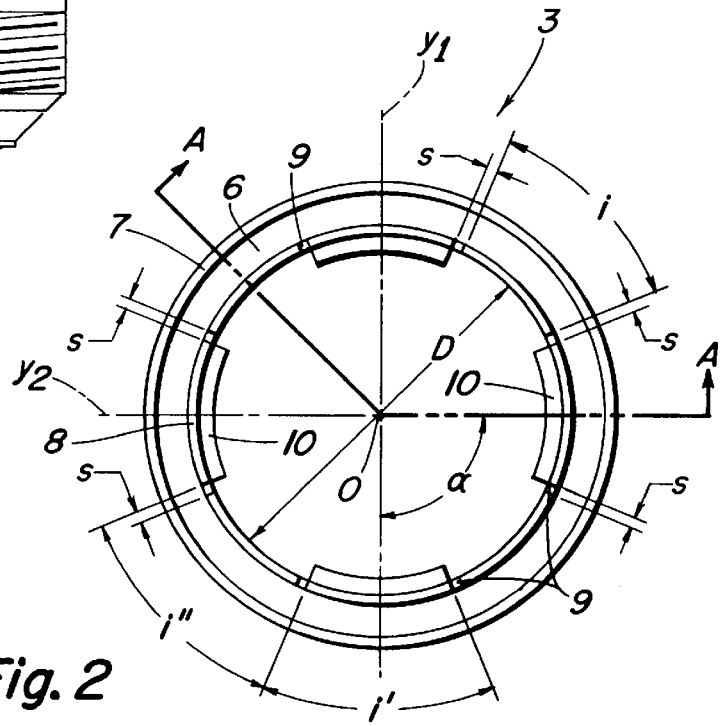
FIG. 2 is the top view of the fixing component according to the invention.

In FIGS. 2 through 4, the annular shaped fixing component 3 is shown on a larger scale, the upside open groove 6 of which is bordered by an outside wall 7 having a broken-line profile and giving the groove 6 a decreasing cross-section at its bottom, and an inside wall 8 that is lower than the outside wall 7, the height difference being m. From the inside wall 8, ribs 10 made from a resiliently deformable material protrude inwards at some places. In the present embodiment two ribs 10 are used at each opposite side, the centerlines y1, y2, of which, starting in radial direction from center 0 make angles $\alpha$=90° with each other, and the length i' of which measured along each arc of rib 10 amounts to approximately one eighth of the perimeter of the inside wall 8 (FIG. 2). Spacing i" also amounts to approximately one eighth of the said perimeter; spacing i' is twice the width s of openings 9 and is smaller than spacing i".

In this embodiment the openings 9 have spacings i measured along an arc and are formed in the inner wall 8 of fixing component 3 as slots starting from the upper rim of inner wall and may extend to the region of the bottom of groove 6. The width s of openings 9 is to be chosen depending on the type of the adhesive material 4 and the number of openings 9; this dimensions may, in practice range between 1.0 and 3.0 mm in case of an epoxy-base thixotrope adhesive. As an example, the dimensions indicated in FIG. 3 may have the following values: dimension h, 6.6 mm, dimension H, 7.6 mm, dimension m, 3.0 mm and the value of diameter D, 58.0 mm. The entire fixing component (annular adapter) 3 can be made as one member from some plastic material by means of injection molding, due to which the resilient deformability of ribs 10 is ensured in advance.

By means of the fixing component 3 according to the invention, lamp envelope 2 is connected to compact fluorescent lamp 1 as follows.

As the first step, fixing component 3 is pulled over the housing 1*a* of compact fluorescent lamp 1 and ribs 10 (FIGS. 2 and 3) are snapped into a notch indented into the outer side of housing 1*a* and extending along a circle (FIG. 1). It is to be emphasized that ribs 10 need not to bear a torsion or other type of load caused by the use of the light source; their thickness or, in other words, their strength should only ensure the safety needed to keep fixing component 3 in a height position relative to housing 1*a*, until the completion of the operation of gluing.

As the next step, into the groove 6 of fixing component 3 clamped on housing 1*a*, an adhesive material (glue) 4 is filled which is flowing, but, of course has an appropriate viscosity; it is not necessary that this adhesive material 4—as seen in FIGS. 1 and 4—extends to the upper rim of the inner wall 8: it is sufficient to choose the height b of adhesive material 4 (see FIG. 4) so that the adhesive material 4 flows through the openings 9 safely and in sufficient quantity to the outer surface of housing 1*a*, and the rim (neck portion) of lamp envelope 2 should protrude into the adhesive material 4 to a depth c being sufficient to result in a perfect safety of bond due to the fixing of the rim. Also, it is not necessary that the groove 6 is filled up over its full length, it can be sufficient to teed the liquid or thixotrope adhesive material 4 into the grooves 6 in the vicinity of openings 9 only (i.e. nearly in spots).

Feeding the adhesive material 4 into groove 6 is—logically prior to solidifying of the adhesive—followed by pushing the rim of lamp envelope 2 into groove 6 which means to push it into adhesive material 4.

By solidifying of adhesive material 4, a firm and highly reliable joint comes into being between fixing component 3 and compact fluorescent lamp 1 on one part and between fixing component 3 and lamp envelope 2 on the other.

Of course, the fixing component according to the invention can be applied not only in compact fluorescent lamps but in any light source having a housing.

The advantages associated with the invention are as follows. Since light source and lamp envelope can—due to the continuity of adhesive material between them—be considered as being fixed directly to each other, the fixing component itself is not exposed directly to such an extent of—e.g. torsion—loads as the state-of-the-art fixing components for the same purpose which are connected to the light source using a mechanical (snapped) joint only. Due to this fact, the fixing component according to the invention is—since its basic role is to accept and keep the adhesive material rather than to bear and transmit forces—less demanding, so it can be made from less material in a simpler and cheaper way than those according to the earlier solutions for similar purposes. Its use can be further economized by saving a great part of the rather expensive adhesive material: it is not necessary that the groove is filled up with adhesive material over its full length, it is satisfactory to feed adhesive material in the vicinity of bypass openings only.

The invention, of course, is not limited to the embodiment of the fixing component described previously, it can be implemented in several ways within the scope of protection defined by the claims.

What is claimed is:

1. A light source including:

a lamp envelope;

a housing; and, a fixing component which joins the lamp envelope to the housing, which fixing component has a groove which accents an adhesive material and receives the lamp envelope, which groove is fixed to the housing and extends along a circle and is bordered by walls at a certain distance from each other characterized in that in the wall (8) of the groove (6) being at a side closer to the housing (1*a*), openings (9) are formed that enable the adhesive material (4) to flow out of the groove to a surface of the housing (1*a*), the walls of the groove receiving the lamp envelope therebetween.

2. A light source according to claim 1 characterized in that the openings (9) are formed in the wall (8) with identical lateral distances (I) from each other.

3. A light source according to claim 1 characterized in that the openings (9) are formed as slots starting from a rim of the wall (8) and having width(s) of 1 to 3 mm.

4. A light source according to claim 1 characterized in that said fixing component has resiliently deformable ribs (10) which fix the groove (6) mechanically to the housing (1*a*) which ribs protrude from the wall (8) closer to the housing (1*a*) and are snapped into a notch (5) indented into an outside surface of the housing (1*a*).

5. A light source according to claim 4 characterized in that the ribs (10) have identical lengths (l') and are spaced at identical lateral distances (l") from each other.

6. A light source according to claim 4 characterized in that the notch (5) is covered by the openings (9) formed in the wall (8).

7. A light source according to claim 1 characterized in that said fixing component has an annular shape.

8. A light source according to claim 1 characterized in that said fixing component is formed from plastic material as one member, by means of injection molding.

9. The light source of claim 1 wherein the light source is a compact fluorescent lamp.

* * * * *